US005331808A

United States Patent [19]

Koike

[11] Patent Number: 5,331,808

[45] Date of Patent: Jul. 26, 1994

[54] OXYGEN-SENSOR ABNORMALITY DETECTING DEVICE FOR INTERNAL COMBUSTION ENGINE

[75] Inventor: Satoshi Koike, Kariya, Japan

[73] Assignee: Nippondenso Co., Ltd., Kariya, Japan

[21] Appl. No.: 46,182

[22] Filed: Apr. 14, 1993

[30] Foreign Application Priority Data

Apr. 16, 1992 [JP] Japan ..... 4-096673

[51] Int. Cl.[5] ..... F01N 3/28

[52] U.S. Cl. ..... 60/276; 60/277; 123/688; 123/691; 123/697

[58] Field of Search ..... 60/276, 277; 123/688, 123/691, 697

[56] References Cited

U.S. PATENT DOCUMENTS 4,747,265 5/1988 Nagai ..... 123/688

5,167,120 12/1992 Junginger ..... 123/697

*Primary Examiner*—Douglas Hart

*Attorney, Agent, or Firm*—Cushman, Darby & Cushman

[57] ABSTRACT

An oxygen-sensor abnormality detecting device for detecting abnormalities in an Oz sensor for air-fuel ratio detection in an internal combustion engine. In exhaust passage 9, a converter 10 is installed which contains a three-way catalyst for removing three harmful components HC, CO, and NOx of automotive emission. In the catalytic converter 10, a catalyst temperature sensor 11 is installed which detects catalyst temperature of the converter. $O_2$ sensors 12 and 13 are provided along the exhaust passage on the upstream side and the downstream side of the catalytic converter 10. For the $O_2$ sensors 12 and 13, the heaters 12*a* and 13*a* are provided for promoting the activity of the $O_2$ sensors 12 and 13. Control circuit 15 checks the catalyst temperature and compares output voltages of the Oz sensors with reference levels under an inactive temperature state of the catalytic converter. The control circuit detects abnormalities in the downstream sensor by comparing results of the comparison of the sensor output voltages.

9 Claims, 6 Drawing Sheets

START
501
XDOX = 1 ?
NO
YES
502
FI = 1 ?
NO
YES
CFR←0
CRR←0
CTM←0
503
CFR←0
CRR←0
CTM←0
FI←0
504
514
CTM←CTM+1
SET α
505
506
UPSTREAM O2 SENSOR OUTPUT 0.45V OR HIGHER ?
NO
YES
507
CFR←CFR+1
508
DOWNSTREAM O2 SENSOR OUTPUT 0.45V OR HIGHER ?
NO
YES
509
CRR←CRR+1
NO
CTM>α ?
510
YES
511
CFR−CRR>β?
YES
NO
512
513
DOWNSTREAM O2 SENSOR NORMAL
DOWNSTREAM O2 SENSOR ABNORMAL
END

OXYGEN-SENSOR ABNORMALITY DETECTING DEVICE FOR INTERNAL COMBUSTION ENGINE

BACKGROUND OF THE INVENTION

This invention relates to an abnormality detecting device for internal combustion engines, and more specifically to an abnormality detecting device for detecting abnormality in the air-fuel ratio sensors disposed on the upstream and downstream sides of the catalytic converter.

Generally, in the exhaust system of an internal combustion engine, there are provided a catalytic converter for controlling the discharge of the emission and an $O_2$ sensor for monitoring the oxygen density of the emission. In recent years, the emission regulations have been reinforced, as the result of which it has been required that the component parts such as the catalytic converter and the $O_2$ sensor should be checked for abnormality.

Japanese Utility Model Application Laid-Open No. Hei-3-87949 discloses a device for detecting abnormality of the $O_2$ sensors. In this abnormality detecting device, two $O_2$ sensors are provided, one on the upstream side and the other on the downstream side of the catalytic converter installed in the exhaust system. When the catalytic converter is in the inactive state, the output response time of the downstream side $O_2$ sensor is detected, and from this output response time, abnormality of the $O_2$ sensor, its deterioration, for example, is determined.

However, generally speaking, if the catalytic converter is in the inactive state, since the temperature of this converter and its surroundings is not raised, so that the $O_2$ sensor is often in the inactive state, too. And, when in the inactive state, even if its function is normal, the $O_2$ sensor is sometimes erroneously determined as abnormal by the abnormality detecting device. For this reason, the conventional abnormality detecting device has a problem in terms of accuracy of abnormality detection.

SUMMARY OF THE INVENTION

The present invention has been made to solve the above problem, and has as its object to provide an abnormality detecting device which has an $O_2$ sensor free of detection error and which is capable of abnormality detection with high accuracy.

According to an aspect of the present invention, there is provided an abnormality detecting device for use in internal combustion engines, comprising a catalytic converter installed in the exhaust system of an internal combustion engine; air-fuel ratio sensors, installed on the upstream and downstream sides of the catalytic converter, for detecting the air-fuel ratio; heaters for activating the air-fuel ratio sensors; means for determining the activity state of the catalytic converter; means for determining the activity state of the air-fuel ratio sensors; means for controlling the heat generation of the heaters; and means for detecting abnormality of an air-fuel ratio sensor from a comparison result by comparing outputs of the upstream side and downstream side air-fuel ratio sensors when the catalytic converter is determined to be in the inactive state by the catalytic converter activity state determining means and the air-fuel ratio sensors are determined to be in the active state by the air-fuel ratio sensor activity state determining means.

According to the above structure, when the catalytic converter is in the inactive state as at a cold start and the air-fuel ratio sensors are put in the active state by heat generated by the heaters, the abnormality detecting device compares outputs of the upstream side and downstream side air-fuel ratio sensors, and from the comparison results, detects an air-fuel ratio sensor which is abnormal.

According to the present invention, there is provided an excellent effect that this abnormality detecting device can keep the air-fuel ratio sensors in the active state invariably when abnormality detection is performed, and can carry out reliable abnormality detection free of detection errors.

DESCRIPTION OF THE PREFERRED EMBODIMENT

With reference to the accompanying drawings, an embodiment of the present invention will be described.

Figure 1:
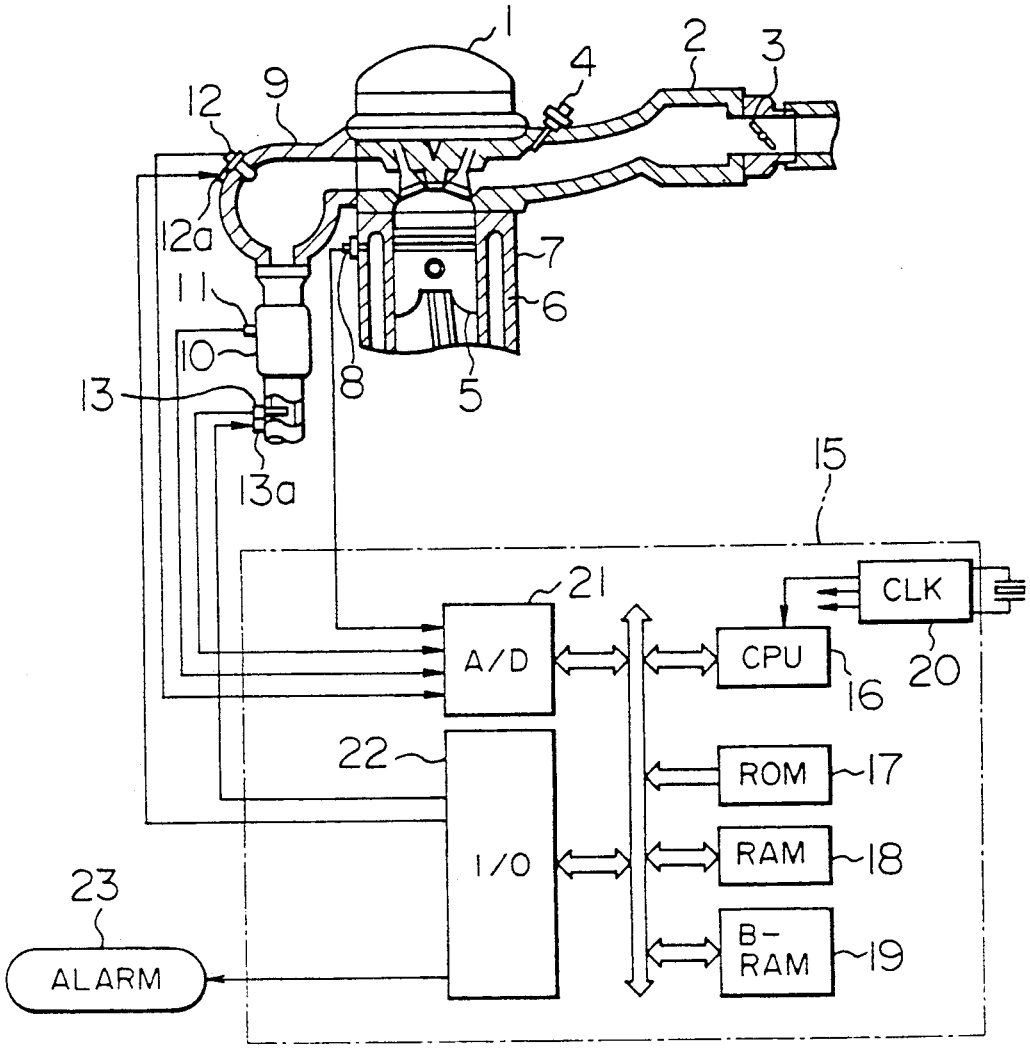
FIG. 1 is a diagram showing the structure of an embodiment of the present invention.

FIG. 1 is a diagram showing a structure of an embodiment of the present invention. In FIG. 1, on the upstream side of a suction passage 2 of an engine main body 1, a throttle valve is installed which is opened and closed interlockingly with the operation of an accelerator pedal, not shown, while on the downstream side of the suction passage 2, a fuel injection valve is installed which supplies the engine main body 1 with a pressurized fuel from a fuel supply system.

A reciprocating piston 5 is installed in a cylinder block 6 of the engine main body 1. A water temperature sensor 8 for detecting the temperature of cooling water is mounted to the water jacket 7 of the cylinder block 6. The water temperature sensor 8 generates an analog voltage signal according to the temperature of the cooling water.

In an exhaust passage 9, a catalytic converter 1 is installed which includes a three-way catalyst for simultaneously removing three harmful components, HC, CO, and NOx from automotive emission. The catalytic converter 10 has attached thereto a catalyst temperature sensor 11 for detecting the temperature of the catalyst. Based on the catalyst temperature, it is decided whether the catalytic converter 10 is in the active or inactive state. To be more specific, in this embodiment, if the criterion with which to decide the active or inactive state is set at 100° C., when the catalyst temperature is below 100° C., it is decided that the catalytic converter is in the inactive state.

An upstream side $O_2$ sensor 12 and a downstream side $O_2$ sensor 13 used as the air-fuel ratio sensors are mounted along the exhaust passage 9 respectively on the upstream side and the downstream side of the catalytic converter 10. The $O_2$ sensors 12 and 13 output voltage signals according to the oxygen density of the automotive emission. Based on these output signals, the air-fuel ratio is controlled.

The $O_2$ sensors 12 and 13 have attached thereto heaters 12*a* and 13*a* for promoting the activity of the $O_2$ sensors 12 and 13. The heaters 12*a* and 13*a* are put under current conduction and generates heat in response to a current conduction signal from a control circuit to be described later.

An alarm 23 issues a warning in response to an abnormality detection signal when abnormality of the downstream side $O_2$ sensor 13 is detected.

The control circuit 15 functions as the catalytic converter activity state determining means, the air-fuel ratio sensor activity state determining means, the heat generation control means, and the abnormality detecting means. This control circuit 15 comprises a CPU 16, a ROM 17, a RAM 18, a backup RAM 19, a standard clock pulse generating circuit 20, an A/D converter 21, and an I/O port 22. The control circuit 15 receives detection signals from the water temperature sensor 8, the catalyst temperature sensor 11 and the upstream side and downstream side $O_2$ sensors 12 and 13, and data thus supplied are stored temporarily in RAM 18. RAM 18 contains a heater current conduction flag, an $O_2$ sensor activity state flag, an abnormality detecting condition fulfillment flag, and various counters, which will be described later. ROM 17 stores programs shown in FIGS. 2 to 5, which will be described later.

The operation of the abnormality detecting device according to this embodiment will now be described.

Figure 6:
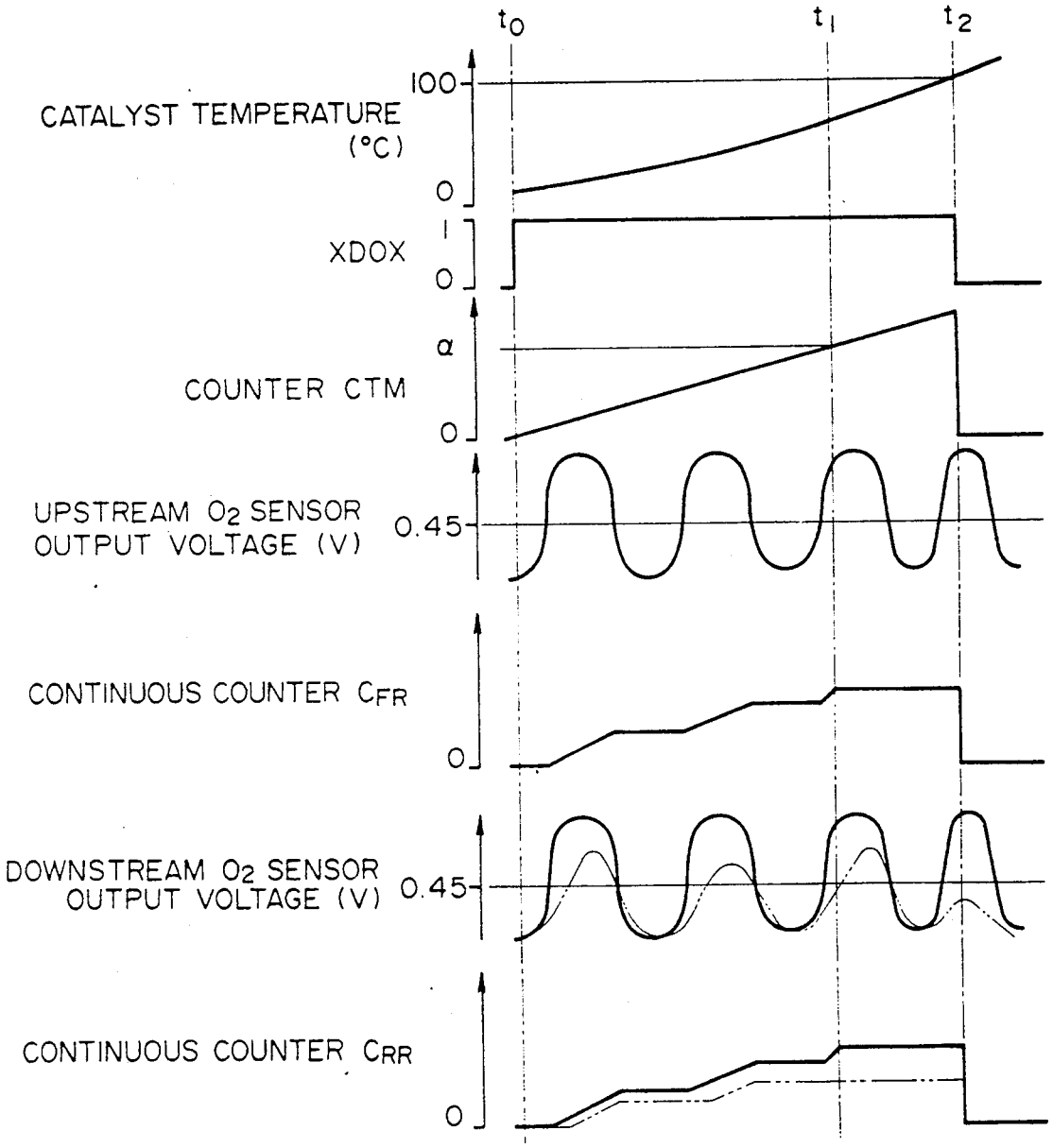
FIG. 6 is a timing chart for explaining the operation.

The abnormality detecting operation will first be described using the timing chart in FIG. 6. A timing when an abnormality detecting operation is started is denoted by $t_0$, a timing when the abnormality detecting operation time has elapsed since the start of the detecting operation is denoted by $t_1$, and a timing when the catalyst temperature exceeds 100° C. is denoted by $t_2$.

At the timing $t_0$, the heaters 12*a* and 13*a* start to generate heat, the abnormality detecting condition fulfillment flag XDOX in RAM 18 is set to "1", and a condition counter CTM and state counters $C_{FR}$, and $C_{RR}$ in RAM 18 are all set to "0".

When an abnormality detecting operation starts, the output voltages of the upstream side and downstream side $O_2$ sensors 12 and 13 are read, and only when the output voltages exceed 0.45V, the counts of the continuous counters $C_{FR}$ and $C_{RR}$ are each incremented by 1. In a chart showing the output voltage of the downstream side $O_2$ sensor 13, the output voltage when the sensor is normal is indicated by a solid line and the output voltage when the sensor is abnormal is indicated by the two-dot chain line. As is obvious from this chart, when the sensor is abnormal, the output voltage decreases and the value of the continuous counter $C_{RR}$ decreases, too. This results from a deterioration of output response of the downstream side $O_2$ sensor 13 which is abnormal.

At timing $t_1$, a difference of the values of the continuous counters ($C_{FR}-C_{RR}$) for the upstream side and the downstream side $O_2$ sensors 12 and 13 is compared with a predetermined value, and if there is a large difference between them, the sensor is determined as abnormal. More specifically, when abnormality occurs as shown by the two-dot chain line, the difference of the values of the continuous counters ($C_{FR}-C_{RR}$) increases. Due to this abnormality, the above-mentioned alarm 23 is operated.

At timing $t_2$ when the catalyst temperature exceeds 100° C., the abnormality detecting condition fulfillment flag XDOX resets to "0", and the counters CTM, $C_{FR}$, and $C_{RR}$ are all cleared to "0".

The operation of the abnormality detecting device will next be described in detail using the flowcharts in FIGS. 2 to 5. The routines in FIGS. 2 to 5 are started every predetermined time, say, every 64 ms.

Figure 2:
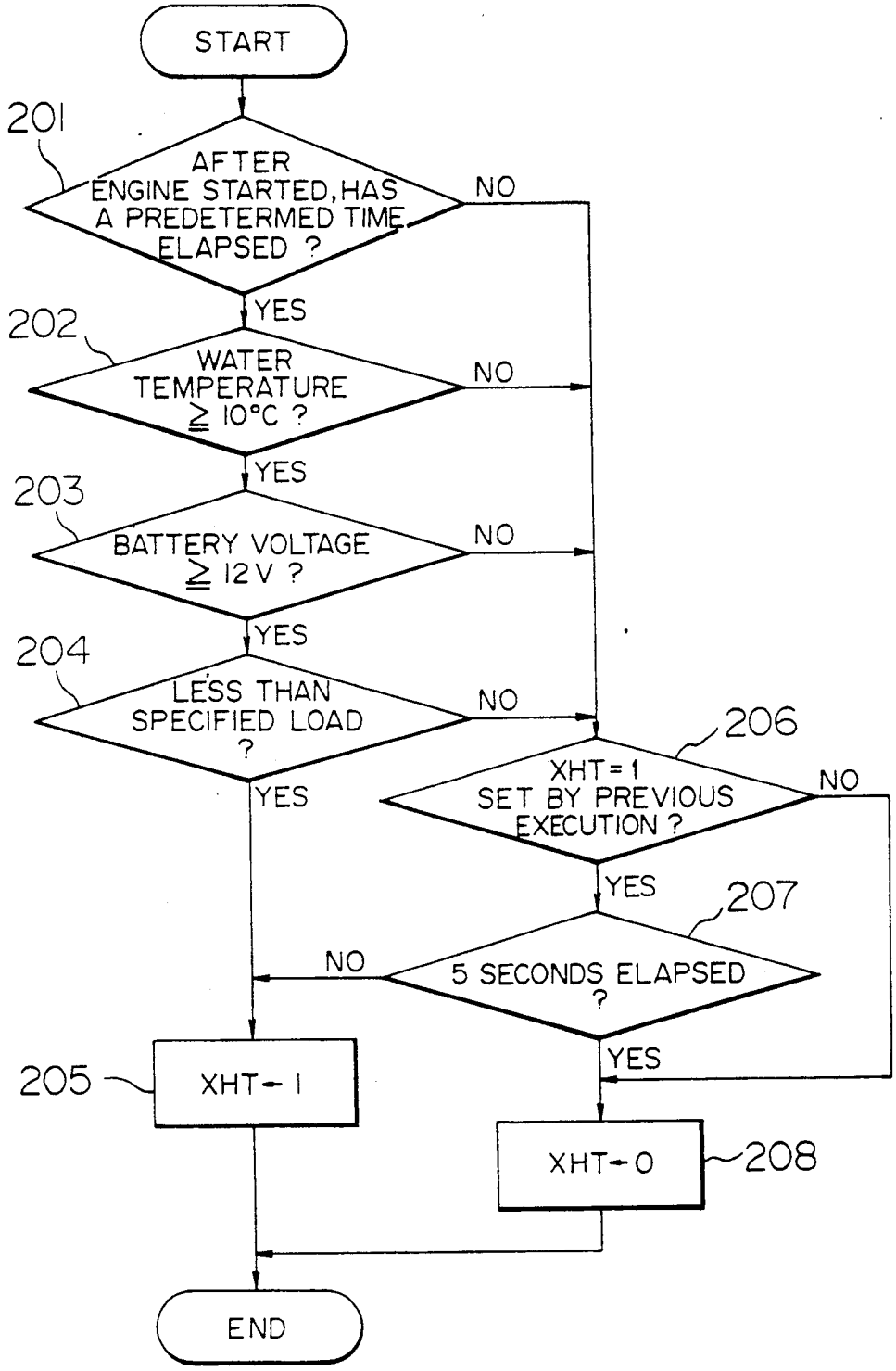
FIG. 2 is a flowchart showing a heater power application routine.

When the internal combustion engine is started, the control circuit starts the routine in FIG. 2, namely, the current conduction routine for the $O_2$ sensor heaters 12*a* and 13*a*.

When this routine is started, the control circuit 15 determines whether or not the conditions at steps 201 to 204 have been fulfilled. More specifically, at step 201, a decision is made whether a predetermined time (three seconds, for example) has elapsed since the internal combustion engine was started. At step 202, a decision is made whether the water temperature detected by the water temperature sensor 8 is at a predetermined level (10° C.) or above. At step 203, a decision is made whether the battery voltage is at a predetermined voltage (12V) or above. Further, at step 204, a decision is made whether the load on the internal combustion engine is within a predetermined value.

Based on the above decisions, a decision is made whether the internal combustion engine is within a normal safe range just after it was started. If all the decision conditions at steps 201 or 204 have been fulfilled, the control circuit 15 proceeds to step 205, and if any of those conditions has not been fulfilled, moves on to step 206.

The control circuit 15, when it proceeds to step 205, regarding the current conduction conditions for the heaters 12*a* and 13*a* as having been fulfilled, set the heater current conduction flag XHT to "1". Simultaneously with the setting of the flag XHT, the heaters 12*a* and 13*a* start to generate heat, whereby the action to promote the activity of the $O_2$ sensors 12 and 13 is started.

The control circuit 15, when proceeding to step 206, determines whether the heater current conduction flag XHT is already set to "1". If the heater current conduction flag XHT is already set to "1", the control circuit 15 proceeds to step 207, and if the heater current conduction flag XHT is "0", advances to step 208.

The control circuit 15, when proceeding to step 207, determines whether the elapsed time since it proceeded to step 206 is five seconds or less. If the elapsed time is more than five seconds, the control circuit 15 moves on to step 208 where it sets the heater current conduction flag XHT to "0", and stops the heat generation of the heaters 12*a* and 13*a*. In other words, by processing at steps 206 and 207, if the conditions at steps 201 to 204 are not fulfilled, the control circuit 15 does not immediately turn off the current to the heaters 12*a* and 13*a*, but turns off the current after a five seconds delay.

Then, the control circuit 15 starts the routine that determines the activity state of the $O_2$ sensor. Note that this routine makes a decision only for the downstream side $O_2$ sensor 13.

In this routine, the control circuit 15 at step 301 determines whether the heater current conduction flag XHT in the above-mentioned routine in FIG. 2 is "1". If the heat current conduction flag XHT is "1", the control circuit proceeds to step 302, and if the flag is not "1", proceeds to step 307. The control circuit 15, on advancing to step 307, sets the $O_2$ sensor activity state flag XOXP to "0". In other words, since the heater is not under current conduction, the downstream side $O_2$ sensor 13 is determined to be in the inactive state.

On the other hand, the control circuit 15, when proceeding to step 302 from step 301, reads the output voltage of the downstream side $O_2$ sensor 13, and at step 303, determines whether the output voltage of the downstream side $O_2$ sensor 13 is 0.45V or higher. In other words, the control circuit 15 at step 303 determines whether the downstream side $O_2$ sensor 13 is in the active or inactive state with reference to a threshold value of 0.45V output from the downstream side $O_2$ sensor 13.

When the output voltage of the downstream side $O_2$ sensor 13 is 0.45V or higher, that is, when the downstream side $O_2$ sensor 13 is in the active state, the control circuit 15 proceeds to step 304, and increments the continuous counter COXR of the downstream side $O_2$ sensor 13 by 1, and advances to step 305. When the output voltage of the downstream side $O_2$ sensor 13 is lower than 0.45V at step 303, that is, when the downstream side $O_2$ sensor 13 is in the inactive state, the control circuit 15 bypasses the step 304 and advances to step 305.

Subsequently, the control circuit 15 at step 305 determines whether the count of the continuous counter COXR is greater than a predetermined value COXD. If the count is greater, the process proceeds to step 306, and if the count is smaller, the process proceeds to step 307. At step 306, the control circuit 15 sets the $O_2$ sensor activity state flag XOXP to "1". At step 207, the control circuit 15 sets the $O_2$ sensor activity state flag XOXP to "0". The processing at step 305 is to repeat decisions a plurality of times to improve the accuracy with which to determine the activity state of the $O_2$ sensor.

Figure 4:
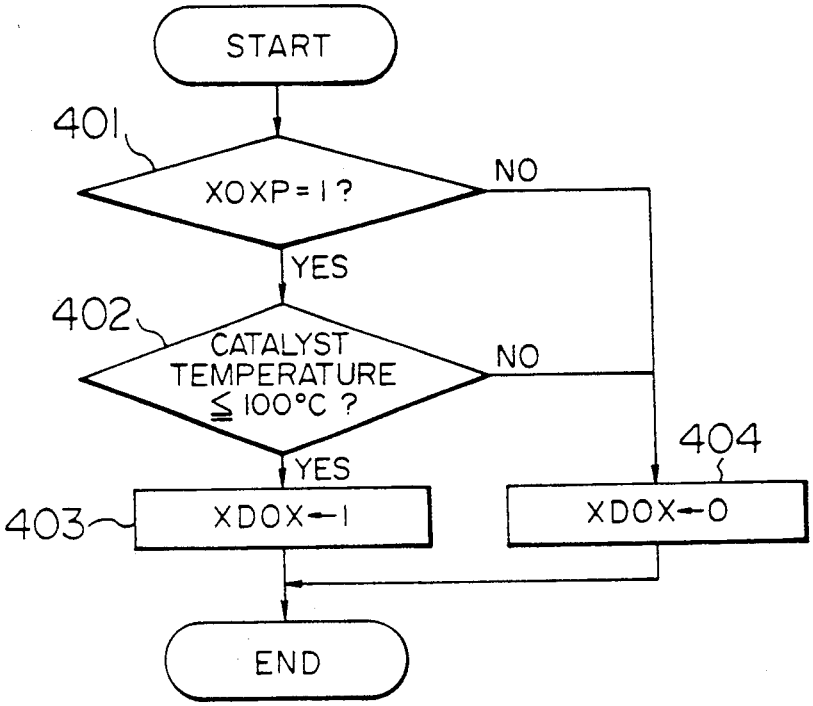
FIG. 4 is a flowchart showing an abnormality detecting condition determining routine.

Then, the control circuit 15 starts an abnormality detecting condition determining routine shown in FIG. 4. This routine is to determine whether the downstream side $O_2$ sensor 13 is in the active state and whether the catalytic converter 10 is in the inactive state, and thereby determines whether the abnormality detecting conditions have been fulfilled.

Figure 3:
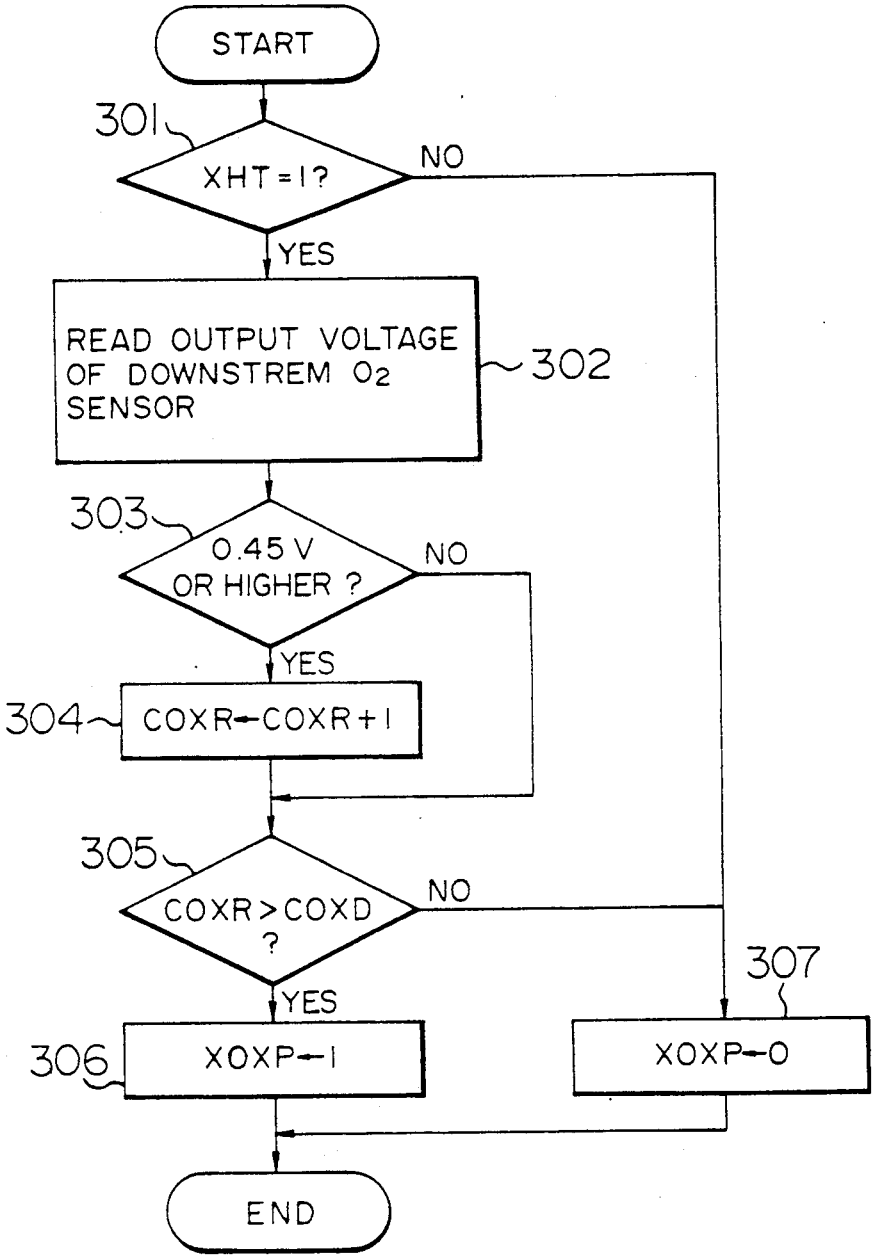
FIG. 3 is a flowchart showing an $O_2$ sensor activity state determining routine.

In this routine, the control circuit 15 at step 401 determines whether the above-mentioned $O_2$ sensor activity state flag XOXP in FIG. 3 is "1". If the $O_2$ sensor activity state flag XOXP is "1", the process proceeds to step 402, and if the flag is "0", proceeds to step 404.

At step 402, the control circuit 15 determines whether the catalyst temperature detected by the catalyst temperature sensor 11 is 100° C. or below. If it is decided that the catalyst temperature is 100° C. or below, that is, if the catalytic converter is determined to be in the inactive state, the control circuit 15 proceeds to step 403. At step 403, the control circuit 15 sets the abnormality detecting condition flag XDOX to "1".

On the other hand, when it is decided at step 401 that the $O_2$ sensor activity state flag XOXP is not "1", or if the catalytic converter 10 is determined at step 402 to be in the active state, the control circuit 15 proceeds to step 404. The control circuit 15 at step 404 sets the abnormality detecting condition fulfillment flag XDOX to "0".

Figure 5:
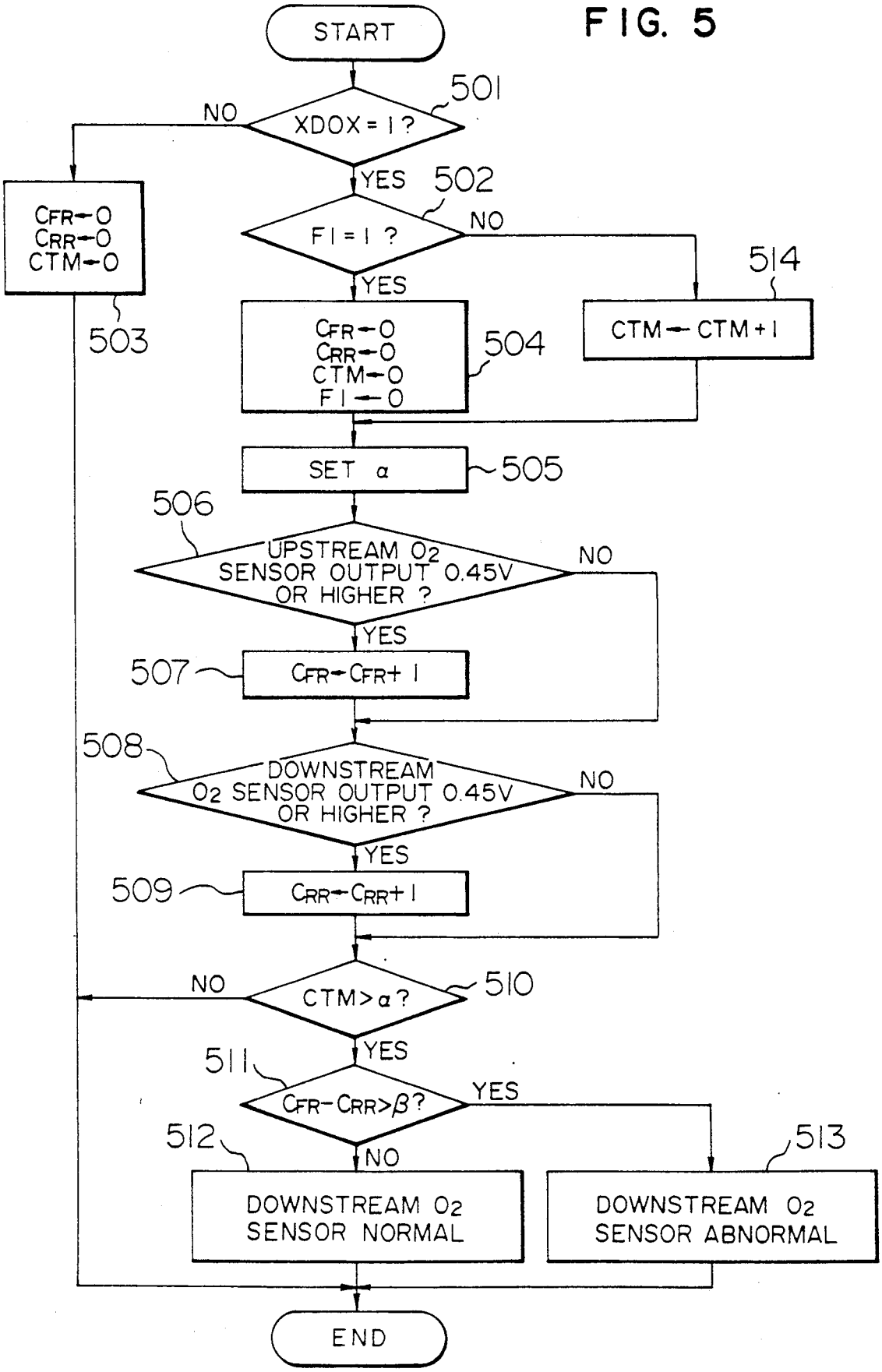
FIG. 5 is an abnormality detection routine.

Next, the control circuit 15 starts the abnormality detecting routine shown in FIG. 5.

In this routine, at step 501, the control circuit 15 determines whether the abnormality detecting condition fulfillment flag XDOX is "1", and if the flag is "0", the control circuit 15 proceeds to step 503, and if the flag is "1", proceeds to step 502.

When moving on to step 503, the control circuit 15 clears the state counters, to be more specific, the continuous counters CRR and CFR, and the condition counter CTM. The control circuit 15, when it proceeds to step 502, determines whether the abnormality detection by this routine is the first round by checking if first flag F1=1 or not. If this is the first round (F1=1), the operation of control circuit 15 proceeds to step 504, and if not (F1=0) it proceeds to step 514. At step 514 the circuit 15 increases count of condition counter CTM by one and proceeds to step 505.

Figure 7:
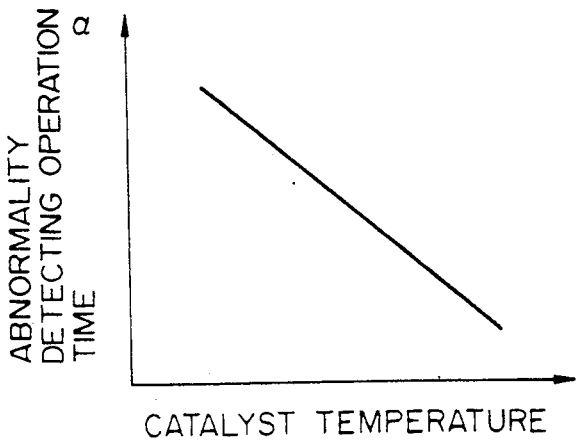
FIG. 7 is a diagram for setting an abnormality detection operation time.

The control circuit 15 at step 504 clears the state counters $C_{RR}$ and $C_{FR}$, the condition counter CTM to initial states and sets first round flag F1=0. This flag F1 is initialized to F1=1 at start time (turning-on of key switch) of the engine. Further, at step 505, the control circuit 15 sets the abnormality detecting operation time $\alpha$ of the downstream side $O_2$ sensor 13. This detecting operation time $\alpha$ can be obtained from FIG. 7, and varies with the kind of catalyst (the maniverter type, underfloor type, for example). The catalyst in this embodiment is of the maniverter type, the temperature of which rises relatively rapidly, so that the abnormality detecting operation time $\alpha$ is short.

When advancing to step 506, the control circuit 15 determines whether the output voltage of the upstream side $O_2$ sensor 12 is 0.45V or above, and if the output voltage is 0.45V or above, increments the continuous counter $C_{FR}$ by 1 at step 507, and then, proceeds to step 508, and if the output voltage is below 0.45V, does not increments the continuous counter $C_{FR}$ and proceeds to step 508.

After this, at step 508, the control circuit 15 determines whether the output voltage of the downstream side $O_2$ sensor 13 is 0.45V or higher. If the output voltage is 0.45V or higher, the control circuit 15 at step 509 increments the continuous counter $C_{RR}$ by 1, and then, proceeds to step 510, and if the output voltage is below 0.45V, without incrementing the counter $C_{RR}$, proceeds to step 510.

At step 510, the control circuit 15 compares the count of the counter CTM which starts counting simultaneously with the start of the abnormality detecting operation and the abnormality detecting operation time $\alpha$ set at step 505. If the count of the counter CTM is higher than the abnormality detecting operation time $\alpha$, the control circuit 15 proceeds to step 511, and determines whether a difference ($C_{FR}-C_{RR}$) of the values of the upstream side and downstream side $O_2$ sensors 12 and 13 is greater than a predetermined value $\beta$. When ($C_{FR}-C_{RR}$) is smaller than the predetermined value $\beta$, the control circuit 15 at step 512 determines that the downstream side $O_2$ sensor 13 is normal, and finishes the routine. When ($C_{FR}-C_{CC}$) is greater than the predetermined value $\beta$, the control circuit 15 at step 513 determines that the downstream side $O_2$ sensor 13 is abnormal, and finishes the routine.

As has been described, in the abnormality detecting device according to this embodiment, the heaters 12*a* and 13*a* are provided respectively for the $O_2$ sensors 12 and 13 installed on the upstream side and the downstream side of the catalytic converter 10. When the catalytic converter 10 is in the inactive state and the downstream side $O_2$ sensor 13 is in the active state, the output voltages of the upstream side and the downstream side $O_2$ sensors 12 and 13 are compared, and the comparison result is used to determine whether the downstream side $O_2$ sensor 13 is abnormal.

Therefore, when the abnormality detecting operation is carried out, invariably, the catalytic converter 10 is put in the inactive state and the $O_2$ sensors 12 and 13 are put in the active state. Therefore, in contrast to the conventional abnormality detecting device, it is possible to preclude detection errors resulting from the $O_2$ sensors 12 and 13 being in the inactive state, so that reliable abnormality detection can be performed.

The present invention is not limited to the above-mentioned embodiment, but can also be carried out in the ways as follows.

(1) As means for determining the inactive state of the catalytic converter 10, the water temperature sensor 8 can be used instead of the catalyst temperature sensor 11. In this case, the condition for determining that the catalytic converter 10 is in the inactive state is the water temperature of 30° C. or below.

(2) In the flowchart in FIG. 5, a criterion for determining abnormality of the upstream side $O_2$ sensor 12 is added to detect abnormality of the upstream side $O_2$ sensor.

What is claimed is:

1. A device for detecting abnormalities in an air-fuel ratio sensor for use in internal combustion engines, comprising:

a catalytic converter installed in an exhaust system of an internal combustion engine;

air-fuel ratio sensors, installed on upstream and downstream sides of said catalytic converter, for detecting the air-fuel ratio;

first and second heaters for activating the upstream-side and downstream side air-fuel ratio sensors, respectively;

means for identifying activity state of said catalytic converter;

means for identifying activity state of said air-fuel ratio sensors;

means for controlling heat generation of said heaters; and means for detecting abnormalities of one of said air-fuel ratio sensors by comparing outputs of said air-fuel ratio sensors when said catalytic converter is identified to be in inactive state and when said air-fuel ratio sensors are identified to be in active state.

2. A device of claim 1, wherein said heat generation control means includes means for starting heating operations of said first and second heaters by detecting a stable operation of said engine after starting of engine operation.

3. A device of claim 2, wherein said heat generation control means includes means for enabling said first and second heaters for a predetermined time duration even with detection of an unstable operation of said engine in time period while said heaters are enabled.

4. A device of claim 1, wherein the sensor-activity identifying means is adapted to check detected output signal of said second air-fuel ratio sensor installed on the downstream side of said converter.

5. A device of claim 1, wherein the converter-activity identifying means includes means for detecting temperature of said catalytic converter, and means for detecting if the detected catalytic-converter temperature is higher than a predetermined temperature.

6. A device of claim 1, wherein said control means includes flag means for enabling said heater in response to detection of predetermined states of engine water temperature, battery voltage and load.

7. A device of claim 2, wherein the sensor-activity identifying means includes 1st counter means for checking continuity of sensor output, and flag means for indicating a sensor activity and enabling the abnormality detecting means in response to a given count of said check counter.

8. A device of claim 3, wherein said abnormality detecting means includes for detecting temperature of said catalytic converter to identify the inactive state of said converter, and flag means for enabling said sensor abnormality detecting means.

9. A device of claim 4, wherein said sensor abnormality detecting means includes means for setting a time period for abnormality detection, 2nd counter means for counting times said upstream sensor output exceeds a reference level in said time period, 3rd counter means for counting times said downstream-side sensor output exceeds a reference level in said time period, and means for comparing difference of counted times of said 2nd and 3rd counter means with a given threshold level to detect abnormalities in said one air-fuel ratio sensor.

* * * * *